United States Patent [19]

Napp et al.

[11] Patent Number: 4,500,833

[45] Date of Patent: Feb. 19, 1985

[54] SWITCHED MODE POWER SUPPLY TRANSFORMER

[75] Inventors: Gerhard Napp, Hemmingen; Ulrich Bieringer, Hanover; Heinz Kreismer, Hanover; Walter Goseberg, Hanover, all of Fed. Rep. of Germany

[73] Assignee: Licentia Patent-Verwaltungs-G.m.b.H., Frankfurt am Main, Fed. Rep. of Germany

[21] Appl. No.: 402,041

[22] Filed: Jul. 26, 1982

[30] Foreign Application Priority Data

Jul. 25, 1981 [DE] Fed. Rep. of Germany ..... 3129381

[51] Int. Cl.[3] ..... H01F 27/28

[52] U.S. Cl. ..... 323/359; 315/405; 336/183; 363/90

[58] Field of Search ..... 336/180, 182, 183, 185, 336/136; 323/359; 315/405; 363/90, 93

[56] References Cited

U.S. PATENT DOCUMENTS

| | | | |
|---|---|---|---|
| 2,137,356 | 11/1938 | Schlesinger . | |
| 3,017,589 | 1/1962 | Chass | 336/136 |
| 3,594,671 | 7/1971 | Frenkel | 336/183 X |
| 3,967,182 | 6/1976 | Scott . | |

FOREIGN PATENT DOCUMENTS

| | | | |
|---|---|---|---|
| 541828 | 1/1932 | Fed. Rep. of Germany . | |
| 578922 | 6/1933 | Fed. Rep. of Germany | 336/183 |
| 182176 | 6/1955 | Fed. Rep. of Germany | 336/183 |
| 1261950 | 2/1968 | Fed. Rep. of Germany . | |
| 1563204 | 9/1969 | Fed. Rep. of Germany . | |
| 2219734 | 10/1973 | Fed. Rep. of Germany . | |
| 2749847 | 5/1979 | Fed. Rep. of Germany . | |
| 547683 | 9/1956 | Italy | 336/180 |
| 254317 | 6/1926 | United Kingdom | 336/180 |

*Primary Examiner*—A. D. Pellinen
*Assistant Examiner*—Susan Steward
*Attorney, Agent, or Firm*—Spencer & Frank

[57] ABSTRACT

A switched mode power supply transformer, particularly for a television receiver, including a primary winding and a secondary winding with the primary winding and the secondary winding each being subdivided into a plurality of respective partial windings. The partial windings of the primary lie in a first group of chambers and the partial windings of the secondary lie in a second group of chambers of a chamber coil body, and the chambers of both groups are nested or interleaved with one another.

15 Claims, 2 Drawing Figures

SWITCHED MODE POWER SUPPLY TRANSFORMER

BACKGROUND OF THE INVENTION

The present invention relates to a switched mode power supply transformer, particularly for a television receiver.

In communications transmissions devices, particularly in television receivers, it is known to effect the desired dc decoupling from the mains by means of so-called switched mode power supply transformers. Such switched mode power supply transformers are substantially smaller and lighter in weight than a mains transformer for the same power operating at 50 Hz, because they operate at a significantly higher frequency of about 20–30 kHz. Such a switched mode power supply transformer (hereinafter called SMPS transformer) generally includes a primary side with a primary winding serving as the operating winding for the switch and further additional auxiliary windings, as well as a secondary side with a secondary winding for generating the essential operating voltage and possibly further additional windings for generating further operating voltages of different magnitude and polarity. The secondary and primary are insulated from one another as prescribed by VDE and have the necessary dielectric strength so that there is no danger of contact between voltage carrying parts on the secondary. A switched mode power supply (SMPS) circuit for a tv-receiver is described in U.S. Pat. No. 3,967,182, issued June 29, 1976.

A further requirement placed on such an SMPS transformer is that the stray inductance at least of the primary winding and of the secondary winding should be as small as possible. With too high a stray inductance, a transient behavior may develop during the switching operation which would not assure optimum switch operation of the switching transistor connected to the primary winding and would endanger this transistor by taking on too much power. Moreover, an increased stray inductance undesirably increases the internal resistance of the voltage sources for the individual operating voltages.

It is known to design the windings for such transformers as layered windings. Such layered windings, however, contain feathered intermediate foil layers and, after manufacture, generally require that the coil or the complete transformer be encased in order to insure VDE safety. Use as a chamber winding in television receivers presently does not take place because of the problems to be discussed below. A chamber winding would have the particular advantage that it could be wound more easily and economically by automatic machines. when using a chamber winding for a switched mode power supply, the detailed insulation between the primary and the secondary would be realized initially by two chambers with one of these chambers being filled only with the windings of the primary and the other of these chambers being filled only with the windings of the secondary. However, with such an arrangement there would exist only slight coupling between the primary and the secondary and thus an undesirably high stray inductance. If, on the other hand, the number of chambers were selected to be substantially larger, the transformer becomes more expensive and unnecessarily large. Moreover, a larger core would be required. Consequently, in the past, no television receiver has been introduced that included an SMPS transformer.

SUMMARY OF THE INVENTION

It is the object of the present invention to provide an SMPS transformer designed in the chamber wound technique which permits economical automatic winding, i.e. can be wound with but a single type of wire, has a structure which is spatially narrow and as flat as possible, provides the required insulation between the primary and secondary windings, and has a low stray inductance. The transformer should not be encased or saturated and nevertheless should produce no interfering noise during operation. The transformer should be able to be held in a circuit board without mechanical aids merely by its connecting terminals which are soldered to the circuit board.

The above object is basically achieved according to the present invention in that the transformer for a switched mode power supply, particularly for a television receiver, comprises: a primary winding and a secondary winding with the primary and secondary windings each being subdivided into a plurality of partial windings; and a chamber coil body with a plurality of chambers; and wherein the partial windings of the primary winding are disposed in a first group of chambers of the coil body, the partial windings of the secondary winding are disposed in a second group of chambers of the coil body, and the chambers of the first and second groups are interleaved.

Due to the fact that the individual windings or partial windings of the primary are disposed only in chambers of the first group and the windings or partial windings of the secondary are disposed only in chambers of the second group, i.e. primary and secondary are distributed to separate chambers, the necessary dielectric strength between primary and secondary is assured. By dividing each of the primary and secondary windings to a respective plurality or group of chambers and, due to the interleaved or nested arrangement of the chambers of the primary and the secondary, the desired fixed coupling between primary and secondary, and thus the desired low stray inductance at the primary and secondary, are realized. It has been found that a total number of chambers in the order of magnitude of six constitutes an economically favorable solution. With a smaller number of chambers, the coupling between primary and secondary is reduced. With a larger number of chambers, however, either the individual chambers become too small or the entire transformer, and particularly the core, become too large.

DETAILED DESCRIPTION OF THE PREFERRED EMBODIMENT

Figure 1:
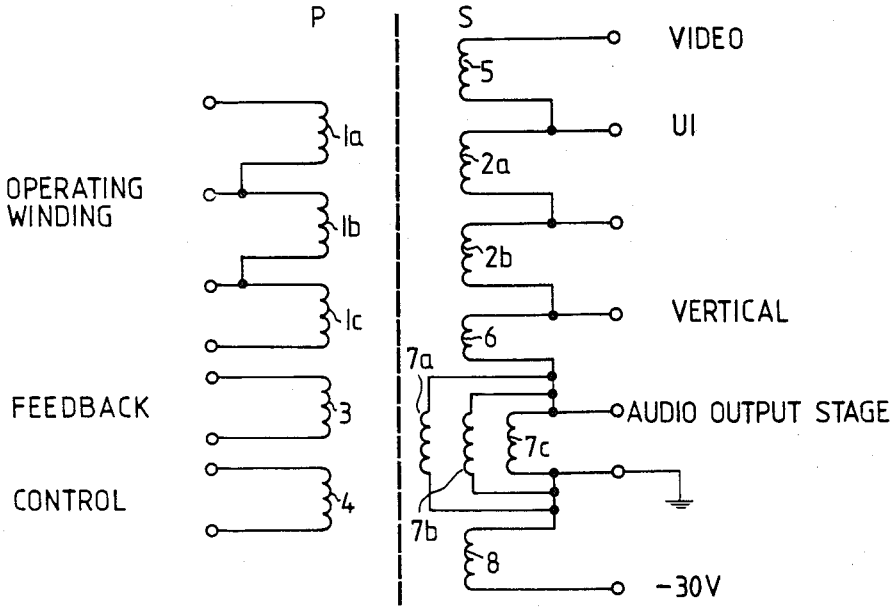
FIG. 1 is a circuit diagram for a preferred embodiment of a switched mode power supply transformer according to the invention.

FIG. 1 shows a transformer intended for a switched mode power supply for a television receiver with a power output between 40 and 150 watts. The transformer includes a primary side P and a secondary side S which, while maintaining the required dielectric strength of, for example, 10,000 V, are galvanically decoupled or separated from one another. The primary side P includes a primary winding 1 which, as the operating winding, will lie in the collector circuit of a switching transistor switched at about 20–30 kHz. The primary winding 1 is divided into three partial windings 1*a*, 1*b* and 1*c* which are connected in series. When utilized in a television receiver, the beginning of partial winding 1*a* and the end of partial winding 1*c* are connected into the collector circuit of the switching transistor, while the taps between the partial windings 1*a*–1*b* and 1*b*–1*c* are not utilized, but rather form supporting points for the connection of the terminals of the partial windings. The primary side P also includes an additional winding 3 which feeds the feedback path with which the primary winding 1*a*–1*c* is designed as a self-resonant circuit. Moreover, the primary side P includes an additional winding 4 for regulating the moment of current flow in the switching transistor in the sense of stabilizing the amplitude of the output voltages on the secondary side S.

The secondary side S initially includes the secondary winding 2 from which is obtained, via a rectifier circuit (not shown), the main operating voltage U1. The secondary winding 2 is divided into two series connected partial windings 2*a* and 2*b*. Additionally, the secondary winding S includes a winding 5 for generating an operating voltage for the video amplifier and a further winding 6 for generating the operating voltage for the vertical deflection stage of a television receiver. Moreover, an additional secondary winding 7 is provided from which, after rectification, the operating voltage or the audio output stage of the receiver is obtained. Winding 7 comprises three partial windings 7*a*, 7*b*, 7*c* which are connected in parallel. The audio output stage of a television receiver has a greatly fluctuating current input between 50 mA and 1000 mA so that the load of the secondary side S varies considerably. This variation in load may effect an undesirable change in the operating voltage U1 which also influences the horizontal deflection amplitude. This undesirable dependency can be reduced in that the coupling between winding 7 and winding 4 is dimensioned greater, for regulating purposes, than the coupling between winding 2 and winding 4. This solution is described in greater detail in Federal Republic of Germany Offenlegungsschrift (laid open application) DE-OS No. 2,749,847 of May 10, 1979. This increased coupling between windings 7 and 4 is realized in the present case by the three parallel connected windings 7*a*, 7*b*, 7*c*. Finally, the secondary S includes a further winding 8 which serves to generate, after rectification, a negative operating voltage of −30 V.

Figure 2:
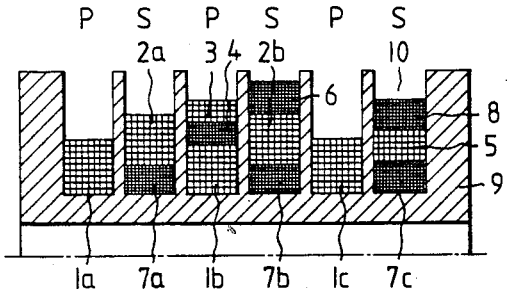
FIG. 2 is a schematic partial sectional view showing the distribution of the individual windings of FIG. 1 to different chambers according to the invention.

FIG. 2 shows one half of the chamber coil body 9 for the individual windings of FIG. 1, with the body 9 including a total of six chambers 10. The size and particularly the widths of the individual chambers 10 can vary with respect to one another and the widths may all be different. Preferably, the width of the narrowest chamber 10 is about 1 mm and the total width of all six chambers is only approximately 20 mm so as to realize a flat and optimally coupled transformer.

As shown, one third of the primary winding 1, in the form of respective partial windings 1*a*, 1*b* and 1*c*, is distributed to each of the first, third and fifth chambers 10 of the coil body 9. The additional primary windings 3 and 4 are disposed in the third chamber 10 above the partial winding 1*b*. One half of the secondary winding 2, in the form of respective partial windings 2*a*, 2*b*, is distributed to each of the second and fourth chambers 10 of the coil body 9. The three partial windings 7*a*, 7*b* and 7*c* of the additional secondary winding 7 for the audio output stage are distributed to the second, fourth and sixth chambers 10, respectively, with the partial windings 7*a*–7*c* being disposed closest to the longitudinal axis of the coil body 9 and thus below any partial secondary winding 2*a*, 2*b* or other secondary winding which may be located in the same chamber. That is, the partial windings 7*a* and 7*b* are disposed below the partial windings 2*a* and 2*b*, respectively, in the respective second and fourth chambers 10, and below the additional secondary windings 5 and 8 in the sixth chamber 10. Further winding 6 is disposed above partial secondary winding 2*b*.

As can be seen in FIG. 2, the chambers 10 contain alternatingly only windings or partial windings of the primary side P or of the secondary side S. The illustrated nesting or interleaving of the windings, i.e. the alternating arrangement of windings of the primary side P and of the secondary side S in successive chambers 10, assures the desired close coupling between the primary side P and the secondary side S. The arrangement of the windings 3, 4 in approximately the center of the coil body 9 above partial winding 1*b* assures the desired close coupling between the windings 3, 4 with the other windings.

In an embodiment of the transformer shown in FIGS. 1 and 2 which was successfully tested in practice, the individual windings were all wound with the same diameter wire and contained the following numbers of turns:

| Winding No. | Number of Turns |
|---|---|
| 1a | 22 |
| 1b | 22 |
| 1c | 22 |
| 2a | 30 |
| 2b | 30 |
| 3 | 3 |
| 4 | 10 |
| 5 | 25 |
| 6 | 1 |
| 7a | 11 |
| 7b | 11 |
| 7c | 11 |
| 8 | 16 |

The diameter of the wire of the windings 1–8 may be about 0.40 or 0.45 mm. Also, each winding may exist of two parallel shunted wires each of 0.3 mm diameter. The width of the six chambers 10—seen from the left to the right in FIG. 2—may be 0.95/1.95/1.75/1.95/0.95/2.75 mm and the thickness of the walls forming the chambers 0.65 mm.

It will be understood that the above description of the present invention is susceptible to various modifications, changes and adaptations, and the same are intended to be comprehended within the meaning and range of equivalents of the appended claims.

What is claimed is:

1. A switched mode power supply transformer, particularly for a television receiver, comprising in combination:

a primary winding and a secondary winding, with said primary winding being subdivided into three partial windings and said secondary winding being subdivided into two partial windings;

a chamber coil body having a plurality of chambers;

said partial windings of said primary winding being disposed only in a first group of said chambers, and said partial windings of said secondary winding being disposed only in a second group of said chambers, with each of said partial windings being disposed in a respective one of said chambers;

said chambers of said first group being interleaved with said chambers of said second group such that they alternate in sequence with said primary partial windings and said secondary partial windings being alternatingly disposed in five successive said chambers, so as to generate the major operating voltage at said secondary winding;

an additional secondary winding for generating a further operating voltage, said additional secondary winding likewise being subdivided into a plurality of partial windings; and, said partial windings of said additional secondary winding are disposed only in respective said chambers of said second group below any of said partial windings of said secondary winding.

2. A transformer as defined in claim 1 wherein the total number of said chambers is six.

3. A transformer as defined in claim 1 wherein the width of the narrowest of said chambers is approximately 1 mm.

4. A transformer as defined in claim 1 or 2 wherein the widths of said chambers are different.

5. A transformer as defined in claim 1 or 2 wherein the total width of all of said chambers is only approximately 20 mm, whereby a flat and optimally coupled transformer is realized.

6. A transformer as defined in claim 1 wherein said additional secondary winding provides an operating voltage for a load which has a fluctuating current input.

7. A transformer as defined in claim 1 wherein said partial windings of said additional secondary winding are connected in parallel.

8. A transformer as defined in claim 1 wherein said partial windings of said primary winding are connected in series.

9. A transformer as defined in claim 1 or 8 wherein said partial windings of said secondary winding are connected in series.

10. A transformer as defined in claim 1 further comprising a plurality of auxiliary primary windings disposed in one chamber of said first group which is disposed in approximately the center of said first group and above the said partial winding of said primary winding disposed in said one chamber of said first group.

11. A transformer as defined in claim 1 wherein all of said partial winding disposed in said chambers of both said groups are wound with wire having the same diameter.

12. A switched mode power supply transformer as defined in claim 1 or 10 wherein: said coil body has six of of said chambers; said additional secondary winding is subdivided into three said partial windings; and two of said partial windings of said additional secondary winding are disposed below respective ones of said partial windings of said secondary winding and the third said partial winding of said additional secondary winding is disposed in the sixth said chamber.

13. A switched mode power supply transformer as defined in claim 10 further comprising at least one further secondary winding disposed in one of said chambers of said second group above any partial secondary winding present in said one of said chambers.

14. A switched mode power supply transformer, particularly for a television receiver, comprising in combination:

a primary winding and a secondary winding, with said primary winding and said secondary winding each being subdivided into a plurality of partial windings;

a chamber coil body having a plurality of chambers;

said partial windings of said primary winding being disposed only in a first group of said chambers, and said partial windings of said secondary winding being disposed only in a second group of said chambers with each of said partial windings being disposed in a respective one of said chambers;

said chambers of said first group being interleaved with said chambers of said second group such that said primary partial windings and said secondary partial windings are alternatingly disposed in successive said chambers, so as to generate the major operating voltage at said secondary winding;

an additional secondary winding for generating a further operating voltage, said additional secondary winding likewise being subdivided into a plurality of partial windings, and said partial windings of said additional secondary winding are disposed only in respective said chambers of said second group below any of said partial windings of said secondary winding.

15. A switched mode power supply transformer as defined in claim 1 or 14 wherein each of said partial windings of said primary winding contains the same number of turns and each of said partial windings of said secondary winding contains the same number of turns.

* * * * *